United States Patent [19]

Groeneveld

[11] Patent Number: 4,609,305

[45] Date of Patent: Sep. 2, 1986

[54] FLOOR FOR USE IN OFF-SHORE TECHNIQUE AND SHIP BUILDING

[75] Inventor: Dirk H. Groeneveld, Ridderkerk, Netherlands

[73] Assignee: 501 Beheermaatschappij H.D. Groeneveld B.V., Bolnes, Netherlands

[21] Appl. No.: 524,573

[22] Filed: Aug. 19, 1983

[30] Foreign Application Priority Data

Aug. 23, 1982 [NL] Netherlands ..... 8203288

[51] Int. Cl.[4] ..... E02B 17/00

[52] U.S. Cl. ..... 405/195; 52/408; 52/451

[58] Field of Search ..... 52/451, 408, 409, 410, 52/411, 412, 413, 414; 405/195–208

[56] References Cited

U.S. PATENT DOCUMENTS

| | | | |
|---|---|---|---|
| 1,172,710 | 2/1916 | Howe | 52/451 |
| 1,677,073 | 7/1928 | Cohen | 52/451 |
| 2,201,102 | 5/1940 | Dean | 52/451 |
| 2,427,273 | 9/1947 | Goble | 52/408 X |
| 2,861,525 | 11/1958 | Curtis et al. | 52/408 X |
| 3,357,147 | 12/1967 | Lerner | 52/451 X |
| 3,388,516 | 6/1968 | Thielen | 52/408 X |
| 3,763,614 | 10/1973 | Hyde et al. | 52/408 X |
| 3,795,180 | 3/1974 | Larsen | 52/408 X |
| 4,021,981 | 5/1977 | Van Wagoner | 52/408 X |
| 4,085,558 | 4/1978 | Albrecht | 52/451 |
| 4,449,336 | 5/1984 | Kelly | 52/408 X |

FOREIGN PATENT DOCUMENTS

| | | | |
|---|---|---|---|
| 0022107 | 1/1981 | European Pat. Off. . | |
| 802405 | 2/1951 | Fed. Rep. of Germany . | |
| 1940198 | 8/1970 | Fed. Rep. of Germany . | |
| 2520199 | 11/1975 | Fed. Rep. of Germany | 52/408 |
| 42184 | 11/1965 | German Democratic Rep. . | |
| 7201097 | 8/1972 | Netherlands . | |

*Primary Examiner*—Dennis L. Taylor

*Attorney, Agent, or Firm*—John P. Snyder

[57] ABSTRACT

The invention relates to a floor for use in off-shore technique and ship building which comprises a subfloor of gutter-shaped metal parts, a first plate bridging the gutter-shaped parts and rigidly connected with these parts and a second plate of pressure-resistant material connected rigidly with the first plate.

10 Claims, 4 Drawing Figures

FIG. 3
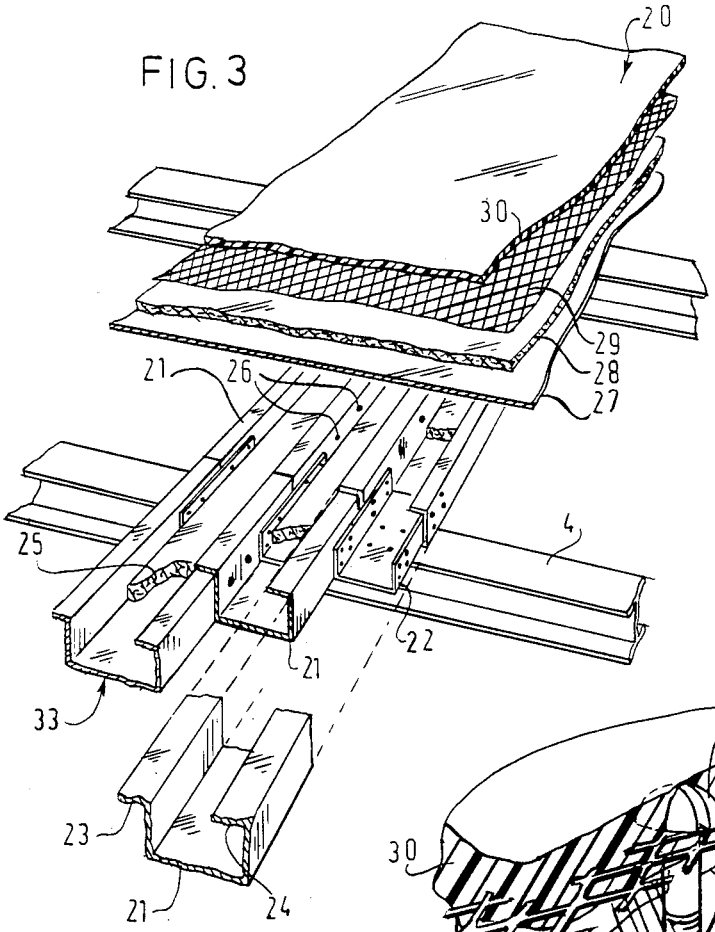
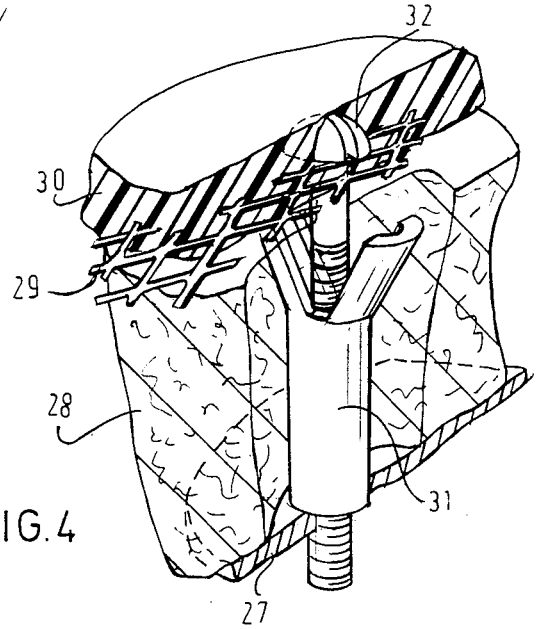
FIG. 4

FLOOR FOR USE IN OFF-SHORE TECHNIQUE AND SHIP BUILDING

The invention relates to a floor for use in off-shore technique and ship building industry.

Such a floor is classically formed by steel plates fixed to girders. The disadvantage of such a known floor construction resides in its heavy weight.

The invention has for its object to provide a floor of the kind set forth which has a low weight and nevertheless satisfies the severe load requirements.

For this purpose the floor embodying the invention comprises a subfloor of gutter-shaped metal parts, a first plate bridging the gutter-shaped parts and rigidly connected herewith and a second plate of pressure-resistant material rigidly connected with the former first plate. The gutter-shaped elements together with the first plate constitute cylinders of high bending resistance and low weight. The first plate is rendered additionally resistant to bending by the second plate. The load perpendicular to the plate surface is converted by the action of the second plate into tractive forces in the first plate so that bending is minimized.

When in accordance with the invention the second plate comprises gauze material connected with the first plate and cured cast material enclosing said gauze material, the desired pressure resistance can be obtained with a low weight.

The gauze material not only serves to provide a satisfactory, durable connection with the first plate but also provides an important, additional advantage. The gauze can withstand tensile force and thus fulfill a diaphragm function in an event of deformation of the gutter-shaped parts due to fire.

The floor embodying the invention can be satisfactorily constructed in the form of a fire trap. For this purpose thermally insulating material is provided in the gutter-shaped parts in accordance with the invention.

A further improvement in fire resistance can be obtained in accordance with the invention by sandwiching a layer of thermally insulating material between the first and the second plate. Together with said layer of insulating material the first and the second plate constitute a sandwich structure which further enhances the carrying capacity of the floor, whilst a low weight is maintained.

When in accordance with the invention the gutter-shaped parts constitute a closed substrate at a distance from the first plate, the first plate, the layer of insulating material and the second plate are protected against fire for a longer time.

In a simple embodiment of the floor in accordance with the invention the gutter-shaped metal parts are formed by a profiled metal plate.

When at least the first plate is connected with the gutter-shaped parts by monel blind rivets, the floor embodying the invention can be quickly mounted. Monel has a sufficiently high melting point to operate satisfactorily even in a floor having the function of a fire trap.

A material suitable as a cast material is, in accordance with the invention, a synthetic resin such as epoxy resin.

The gauze material is preferably plate gauze, since this is structurally strong.

The invention will now be described more fully with reference to the embodiments shown in the accompanying drawings.

FIG. 3 is a view like FIG. 2 of a further embodiment.

FIG. 4 shows a detail of a possible mode of connection of the first plate with the second plate.

Figure 1:
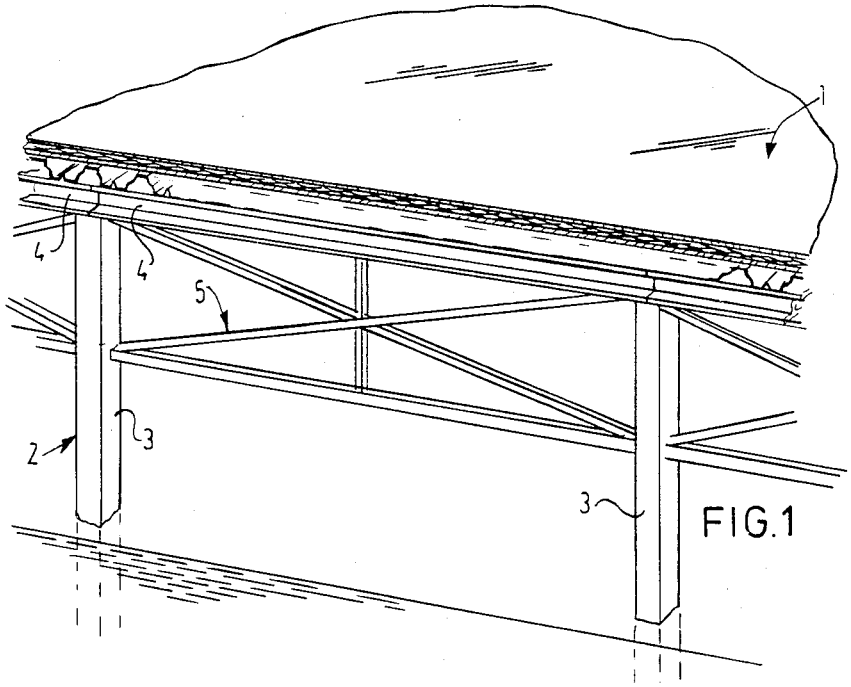
FIG. 1 shows schematically a floor embodying the invention used in an off-shore construction.

FIG. 1 schematically shows an off-shore construction 2. This off-shore constructiOn 2 comprises a plurality of pillars 3 on which girders 4 are arranged. With the pillars 3 and the girders 4 is connected a framework structure 5, which imparts sufficient rigidity to the assembly.

The floor 1 embodying the invention is laid down on the girders 4. As is apparent from FIG. 2 the subfloor 6 of the floor 1 is formed by profiled sheets.

Figure 2:
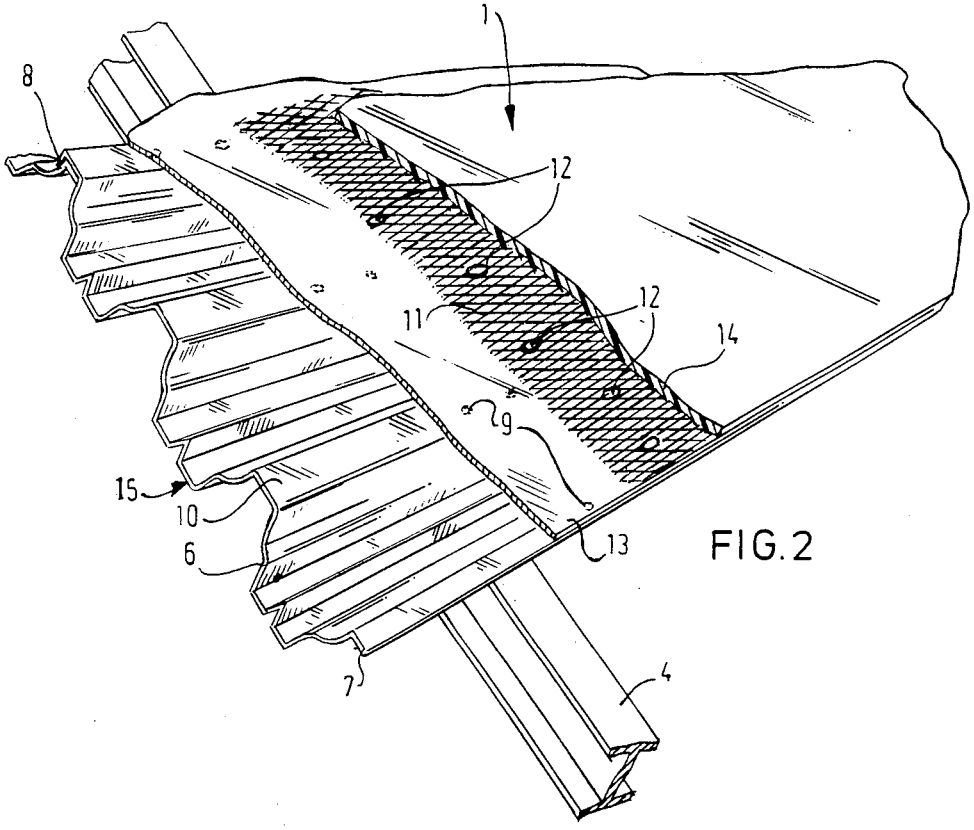
FIG. 2 is a fragmentary, perspective view of the floor shown in FIG. 1.

There is shown a section 15 comprising three gutter-shaped parts. The floor 1 comprises a plurality of such sections 15. As shown in FIG. 2 on the left-hand side the section has a hook-like rim 8 which can grip around a straight edge 7 on the right-hand side of the neighbouring section 15. In this way a surface of any size can be formed by means of a number of sections 15.

On the "peaks" 10 of the wave profile is arranged a steel plate 13. The steel plate is fastened by spot welding to the profiled sheet 6 to form a single unit.

To the steel plate 13 is fastened sheet gauze in the form of expanded metal material 11 with the aid of plate screws 12. Subsequently a layer of synthetic resin 14 is cast on the sheet gauze and allowed to cure, thus embedding the sheet gauze. In this way the synthetic resin adheres not only to the sheet gauze 11, but also to the surface of the steel plate 13.

In a practical embodiment of the floor in accordance with the invention the thickness of the profiled plate 6 is 0.75 mm. The gutter-shaped parts of this embodiment have a width of about 250 mms, whilst the height thereof is about 100 mms. The steel plate 13 has a thickness of 0.75 mm and the synthetic resin layer 14 has a thickness of 6 mms.

FIG. 3 shows a fire-resistant embodiment of the floor in accordance with the invention.

The substrate of the floor 20 comprises gutter-shaped metal parts formed by separate elements 21. Each element 21 has a projecting side rim 23 and a re-entrant side rim 24 of a neighbouring element. The elements 21 are interconnected to form the subfloor by means of monel blind rivets 26. In the direction of length the elements 21 are coupled with one another by tie pieces 22, which are also fastened by means of blind rivets. From FIG. 3 it will be apparent that the elements 21 have a shape such that in the assembled state of the subfloor they form a gutter-shaped bottom surface 33. In the event of fire below the floor the top part of the floor will, therefore, not come into direct contact with the fire.

In the elements 21 is arranged a layer of thermally insulating material 25. This insulating material 25 blocks an upward stream of heat.

To the side rims 24 of the elements 21 is fastened a steel plate 27. This connection may also be established with the aid of monel blind rivets. Then a layer of insulating material 28 is applied to the steel plate 27. The sheet gauze 29 is deposited on the insulating layer 28 and connected with the steel plate 27. After the establishment of the connection between the sheet gauze and the steel plate a layer of synthetic resin 30 is applied to the entire construction, the sheet gauze 29 being embedded therein.

FIG. 4 shows a possible mode of connection between the gauze material 29 and the steel plate 27. This connection is known by the term of INSUL-LOK. This connection comprises a spacer sleeve 31, the top end of which is flared to form a supporting surface for the sheet gauze. Across the sheet gauze and the spacer sleeve extends a bolt 32, which engages the steel plate 27. The bolt 32 is chosen so that its head remains below the surface formed by the layer of synthetic resin 30.

In a practical embodiment the elements have a width of 400 mms and a height of 90 mms. The wall thickness of the elements 21 is 0.75 mm. The steel plate 27 may have a thickness of 0.6 mm. The separate plate parts of the steel plate 27 may be interconnected by spot welding. In this practical embodiment the insulating layer 28 between the first plate 27 and the second plate 29, 30 consists of PROMATECT-L. For the purpose concerned this material has the desired properties. The parts forming the layer of gauze material 29 are interconnected by welding. The thickness of the synthetic resin layer is 6 mms.

The mode of fastening shown in FIG. 4 is only one of the many possibilities. For example, the sheet gauze may be connected with the steel plate 27 by means of a self-drilling plate screw.

As a cast material there may be used, apart from a synthetic resin, material such as concrete.

It will be obvious that the various modes of fastening of the steel plate to the subfloor or of the parts of the subfloor to one another are not limited to those of the embodiments of the invention described above.

Apart from its use in off-shore technique the floor embodying the invention is excellently suitable for use in ship building.

I claim:

1. A floor for use in off-shore technique and ship building comprising a subfloor of gutter-shaped metal parts, a metal first plate overlying the subfloor and bridging the gutter-shaped parts and rigidly connected with these parts to define a series of hollow, closed cylinders therewith possessing substantial resistance to bending, and a second plate overlying said metal first plate, said second plate comprising an expanded metal meterial and means connecting said expanded metal material as a unit with the metal first plate for converting loads bearing on said second plate into tractive forces in said metal first plate to add resistance to bending of said cylinders, said means comprising a surface layer portion of cured cast pressure-resistant material embedding said expanded metal material therein to bond said expaned metal material as a unit with the first metal plate.

2. A floor as claimed in claim 1 including thermally insulating material provided in the gutter-shaped parts.

3. A floor as claimed in claim 1 including a layer of thermally insulating material sandwiched between the first plate and the second plate.

4. A floor as claimed in claim 1 wherein the cast material is a synthetic resin such as epoxy resin.

5. In an off-shore or ship building facility having a plurality of upstanding pillars, a plurality of girders, arranged in generally parallel rows and supported on the upper ends of said pillars, and a framework structure interconnecting said pillars and said pillars with said girders so as to provede a rigid support, the improvement comprising:

a floor assembly laid down on said girders to provide a low weight structure capable of satisfying severe load requirements, said floor assembly comprising a metal substructure resting upon and bridging between said girders, said substructure comprising a bottom structure defining a series of parallel beams of substantial depth with each beam being open along its upper side and extending perpendicular to the directions of said rows of girders, a metal plate overlying said substructure to close off the upper sides of said beams, and fastening means rigidly securing said metal plate to said substructure so that said substructure and said metal plate cooperatively form a series of hollow, closed beams possessing substantial resistance to bending due to loads imposed thereon between said girders; and second plate means overlying and rigidly connected to said metal plate for converting perpendicular loads into tractive forces in said metal plate to add further resistance to bending, said second plate means comprising a layer of expanded metal, securing means rigidly connecting said layer of expanded metal at spaced points to said metal plate, and a surface layer of cured synthetic resinous material embedding said layer of expanded metal therein.

6. In a facility as defined in claim 5 wherein said securing means comprises spacer sleeves bearing against said metal plate and upon which said layer of expanded metal rests, and fastening elements passing through said spacer sleeves so that said metal plate and said layer of expanded metal are disposed in spaced, parallel relation defining a space therebetween, and a layer of insulating material filling said space.

7. In a facility as defined in claim 5 wherein said expanded metal is disposed in face-to-face contact with said metal plate and said surface layer contacts and is adhered to said metal plate.

8. In a facility as defined in claim 6 or 7 including thermal insulating material in each of said beams.

9. In a facility as defined in claim 5 or 7 wherein said substructure comprises a plurality of sections of generally corrugated configuration.

10. In a facility as defined in claim 5 or 6 wherein said substructure comprises a plurality of U-shaped member disposed in side-byside relation, each such member having an outwardly directed flange along the top of one leg thereof and an inwardly directed flange along the top of the other leg thereof, the outwardly directed flange of each member overlying the inwardly directed flange on an adjacent member, and said members being rigidly connected together to form a unitary substructure.

* * * * *